US012674577B2

(12) United States Patent
Gamboa Revilla et al.

(10) Patent No.: US 12,674,577 B2
(45) Date of Patent: Jul. 7, 2026

(54) SYSTEMS AND METHODS FOR FUEL SELECTION FOR COMBUSTION DEVICES

(71) Applicant: Rheem Manufacturing Company, Atlanta, GA (US)

(72) Inventors: Jorge Miguel Gamboa Revilla, Oxnard, CA (US); Troy Edward Trant, Montgomery, AL (US); Amin Monfared, Sherman Oaks, CA (US); Bo Gao, Camarillo, CA (US); Babak Bagheri, Oxnard, CA (US); Sergio Fernando Montalgo Salazar, Oxnard, CA (US)

(73) Assignee: Rheem Manufacturing Company, Atlanta, GA (US)

( * ) Notice: Subject to any disclaimer, the term of this patent is extended or adjusted under 35 U.S.C. 154(b) by 428 days.

(21) Appl. No.: 18/218,492

(22) Filed: Jul. 5, 2023

(65) Prior Publication Data

US 2024/0011631 A1 Jan. 11, 2024

Related U.S. Application Data

(60) Provisional application No. 63/367,746, filed on Jul. 6, 2022.

(51) Int. Cl.
*F23N 1/02* (2006.01)
*F23N 5/24* (2006.01)

(52) U.S. Cl.
CPC ..... *F23N 1/022* (2013.01); *F23N 5/242* (2013.01); *F23N 2227/04* (2020.01); *F23N 2227/06* (2020.01); *F23N 2235/18* (2020.01); *F23N 2237/08* (2020.01)

(58) Field of Classification Search
CPC ..... F23K 2300/203; F23N 2227/06; F23N 2227/04; F23N 2221/10; F23D 14/60; F23D 14/02
See application file for complete search history.

(56) References Cited

FOREIGN PATENT DOCUMENTS

| | | | | |
|---|---|---|---|---|
| CA | 3002355 A1 * | 10/2019 | ..... | F23N 5/02 |
| DE | 4447285 A1 * | 7/1996 | ..... | F23N 5/003 |
| DE | 10024566 C1 * | 1/2002 | ..... | B60H 1/00364 |
| WO | WO-2004059211 A1 * | 7/2004 | ..... | F23N 5/082 |

* cited by examiner

*Primary Examiner* — Jorge A Pereiro
(74) *Attorney, Agent, or Firm* — Eversheds Sutherland (US) LLP

(57) ABSTRACT

A combustion system configured to receive fuel from a plurality of fuel sources, wherein the combustion system includes a burner, a shutter, a fuel selector, and an electronic controller configured to receive an indication of a selected fuel type from the fuel selector and output instructions for the shutter to adjust to a shutter position associated with the selected fuel type, the shutter position being configured to provide a predetermined supply of air to thereby effect an air-to-fuel ratio associated with combustion of the selected fuel type.

20 Claims, 5 Drawing Sheets

SYSTEMS AND METHODS FOR FUEL SELECTION FOR COMBUSTION DEVICES

CROSS-REFERENCE TO RELATED APPLICATIONS

This application claims priority to U.S. Provisional Application No. 63/367,746, filed on Jul. 6, 2022, which is incorporated herein by reference.

FIELD OF THE DISCLOSURE

The present disclosure relates generally to systems and methods for combustion devices and more particularly to systems and methods for fuel selection for combustion devices.

BACKGROUND

Facilities that rely on multiple fuels for a given combustion device often require the flexibility of fuel conversion on-the-fly. For example, facilities with dual-fuel systems may require the ability to quickly and safely switch between fuel sources. Traditionally, these systems require manual selection of the fuel type and manual adjustments to adopt dual fuel compatibility. Certain regulations can require manual selection of a fuel (e.g., for safety purposes), which typically involves a user manually switching a mechanical knob at the unit to select a fuel input. After a fuel input has been selected, existing systems typically require the user to manually tune the unit for the particular fuel selected. This can involve, for example, adjusting the shutter at the unit to provide a user-approximated air-to-fuel ratio for the selected fuel.

Current solutions to this problem are generally complex and expensive. For example, to avoid manually tuning the unit, some systems include a dedicated gas valve and gas train for each fuel type. However, the additional parts and infrastructure required for each fuel type can increase the costs and effort associated with manufacturing, installation, and/or maintenance of the device or system.

Therefore, it would be desirable to provide systems and methods for fuel selection for combustion devices that allow for rapid switchover between fuel types while still ensuring proper ignition and performance (e.g., combustion).

SUMMARY

The present disclosure relates to systems and methods for fuel selection for combustion devices. The disclosed technology includes a combustion system. In some embodiments, the combustion system is configured to receive fuel from a plurality of fuel sources. The combustion system can include a burner, a shutter, a fuel selector, and an electronic controller. The electronic controller can be configured to receive an indication of a selected fuel type from the fuel selector. The electronic controller can be configured to output instructions for the shutter to adjust to a shutter position associated with the selected fuel type. The shutter position can be configured to provide a predetermined supply of air to thereby effect an air-to-fuel ratio associated with combustion of the selected fuel type.

In some embodiments, the combustion system includes a fuel sample valve and a fuel composition sensor. The fuel combustion sensor can be configured to determine a fuel type. The electronic controller can be configured to output instructions for the fuel sampling valve to open. The fuel sampling valve can open to perform a purge of fuel from the combustion system. The purge of fuel can discharge initial fuel (e.g., fuel already present in the combustion system) from the combustion system and can intake replacement fuel into the combustion system. The electronic controller can be configured to receive fuel sample data from the fuel composition sensor. The electronic controller can be configured to compare the fuel sample data to stored fuel data to determine whether the fuel sample data is indicative of the selected fuel type.

In some embodiments, the electronic controller is configured to output instructions for the burner to ignite the fuel in response to determining that the fuel sample data is indicative of the selected fuel type.

In some embodiments, the electronic controller is configured to determine that the fuel sample data is not indicative of the selected fuel type. The electronic controller can be configured to output instructions for a supplemental purge of fuel from the combustion system. The electronic controller can be configured to output instructions for the fuel sampling valve to open to perform a supplemental purge of fuel from the combustion system. The supplemental purge of fuel can discharge the replacement fuel from the combustion system and can intake supplemental replacement fuel into the combustion system. The electronic controller can be configured to receive supplemental fuel sample data from the fuel composition sensor. The electronic controller can be configured to compare the supplemental fuel sample data to stored fuel data to determine whether the supplemental fuel sample data is indicative of the selected fuel type.

In some embodiments, the electronic controller is configured to output instructions for the burner to ignite the fuel in response to determining that the supplemental fuel sample data is indicative of the selected fuel type.

In some embodiments, the electronic controller is configured to, in response to determining that the fuel sample data is not indicative of the selected fuel type, output an alert, e.g., to a user. In addition or in the alternative, the electronic controller can be configured to, in response to determining that the fuel sample data is not indicative of the selected fuel type, output instructions for disabling the burner to prevent ignition of the fuel.

In some embodiments, the combustion system includes one or more fuel selector valves. The one or more fuel selector valves can be configured to selectively permit or prevent flows of fuel from the plurality of fuel sources such that a single flow of fuel is permitted to flow through the one or more fuel selector valves at a given time. The one or more fuel selector valves can include an outlet side. The outlet side can be configured to output the selected fuel type for combustion in the burner.

In some embodiments, the electronic controller is configured to output instructions for the one or more fuel selector valves to permit flow of the selected fuel type.

In some embodiments, the combustion system includes a common manifold. The common manifold can be fluidly connected to the outlet side of each of the one or more fuel selector valves. The common manifold can be fluidly connected to the burner.

In some embodiments, The electronic controller is configured to output instructions for the shutter to adjust to a first position when the selected fuel type is a first fuel type. The first position can be configured to provide an air-to-fuel ratio associated with combustion of the first fuel type. The electronic controller can be configured to output instructions for the shutter to adjust to a second position when the selected fuel type is a second fuel type. The second position can be configured to provide an air-to-fuel ratio associated with combustion of the second fuel type.

In some embodiments, the combustion system includes a combustion efficiency sensor. The combustion efficiency sensor can be configured to measure combustion efficiency of the burner. The electronic controller can be configured to receive combustion efficiency data from the combustion efficiency sensor. The electronic controller can be configured to output instructions for the shutter to modulate based at least in part on the combustion efficiency data.

Methods of tuning a combustion system are also provided. The combustion system can be configured to receive fuel from a plurality of fuel sources. In some embodiments, the method includes actuating a fuel selector valve to permit a flow of fuel of a selected fuel type. The method can include adjusting a shutter to a shutter position associated with the selected fuel type. The shutter position can be configured to provide a predetermined supply of air to the combustion system thereby to effect an air-to-fuel ratio associated with combustion of the selected fuel type. The method can include opening a fuel sampling valve. The method can include purging initial fuel from the combustion system. The purging initial fuel can include discharging initial fuel from the combustion system and intaking replacement fuel into the combustion system. The method can include sampling the replacement fuel with a fuel composition sensor. The fuel combustion sensor can be configured to determine a detected fuel type of the replacement fuel. The method can include comparing the detected fuel type to the selected fuel type.

In some embodiments, the method includes determining that the detected fuel type matches the selected fuel type. The method can include igniting the fuel in the combustion system.

In some embodiments, the method includes determining that the detected fuel type does not match the selected fuel type. The method can include purging the replacement fuel from the combustion system. The purging the replacement fuel can include discharging the replacement fuel from the combustion system and intaking supplemental replacement fuel into the combustion system. The method can include sampling the supplemental replacement fuel with the fuel composition sensor to determine a detected supplemental fuel type of the supplemental replacement fuel. The method can include comparing the detected supplemental fuel type to the selected fuel type.

In some embodiments, the method includes determining that the detected supplemental fuel type matches the selected fuel type. The method can include igniting the fuel in the combustion system.

In some embodiments, the method includes, in response to determining that the detected supplemental fuel type does not match the selected fuel type, outputting an alert. In addition or in the alternative, the method may include, in response to determining that the detected supplemental fuel type does not match the selected fuel type, preventing ignition in the combustion system.

In some embodiments, the method includes selecting the selected fuel type based at least in part on a predetermined occupancy schedule. The method can include selecting the selected fuel type based at least in part on a predetermined demand schedule. The method can include selecting the selected fuel type based at least in part on a current fuel demand associated with the combustion system. The method can include selecting the selected fuel type based at least in part on an occupancy of a space associated with the combustion system. The method can include selecting the selected fuel type based at least in part on a current fuel availability. The method can include selecting the selected fuel type based at least in part on one or more current fuel costs. The method can include selecting the selected fuel type based at least in part on one or more current environmental conditions.

In some embodiments, the method includes adjusting a shutter to a first position when the selected fuel type is a first fuel type. The first position can be configured to provide an air-to-fuel ratio associated with combustion of the first fuel type. The method can include adjusting a shutter to a second position when the selected fuel type is a second fuel type. The second position can be configured to provide an air-to-fuel ratio associated with combustion of the second fuel type.

The method can include receiving combustion efficiency feedback from a combustion efficiency sensor. The method can include modulating the shutter based on the combustion efficiency feedback.

In another aspect, combustion systems are provided that are configured to receive fuel from a plurality of fuel sources. In various embodiments, the combustion system includes a plurality of energy producing apparatuses, a shutter, a fuel selector, a fuel sample valve, a fuel composition sensor configured to determine a fuel type, and an electronic controller. The electronic controller can be configured to receive an indication of a selected fuel type from the fuel selector. The electronic controller can be configured to output instructions to select one of the plurality of energy producing apparatus associated with the selected fuel type. The electronic controller can be configured to output instructions for the shutter to adjust to a shutter position associated with the selected fuel type. The shutter position can be configured to provide a predetermined supply of air associated with the selected fuel type to thereby effect an air-to-fuel ratio associated with combustion of the selected fuel type.

These and other aspects of the present disclosure are described in the Detailed Description below and the accompanying drawings. Other aspects and features of embodiments will become apparent to those of ordinary skill in the art upon reviewing the following description of specific, exemplary embodiments in concert with the drawings. While features of the present disclosure may be discussed relative to certain embodiments and figures, all embodiments of the present disclosure can include one or more of the features discussed herein. Further, while one or more embodiments may be discussed as having certain advantageous features, one or more of such features can also be used with the various embodiments discussed herein. In similar fashion, while exemplary embodiments may be discussed below as device, system, or method embodiments, it is to be understood that such exemplary embodiments can be implemented in various devices, systems, and methods of the present disclosure.

BRIEF DESCRIPTION OF THE DRAWINGS

The following detailed description of specific embodiments of the disclosure will be better understood when read in conjunction with the appended drawings. For the purpose of illustrating the disclosure, specific embodiments are shown in the drawings. It should be understood, however, that the disclosure is not limited to the precise arrangements and instrumentalities of the embodiments shown in the drawings.

DETAILED DESCRIPTION

Figure 1:
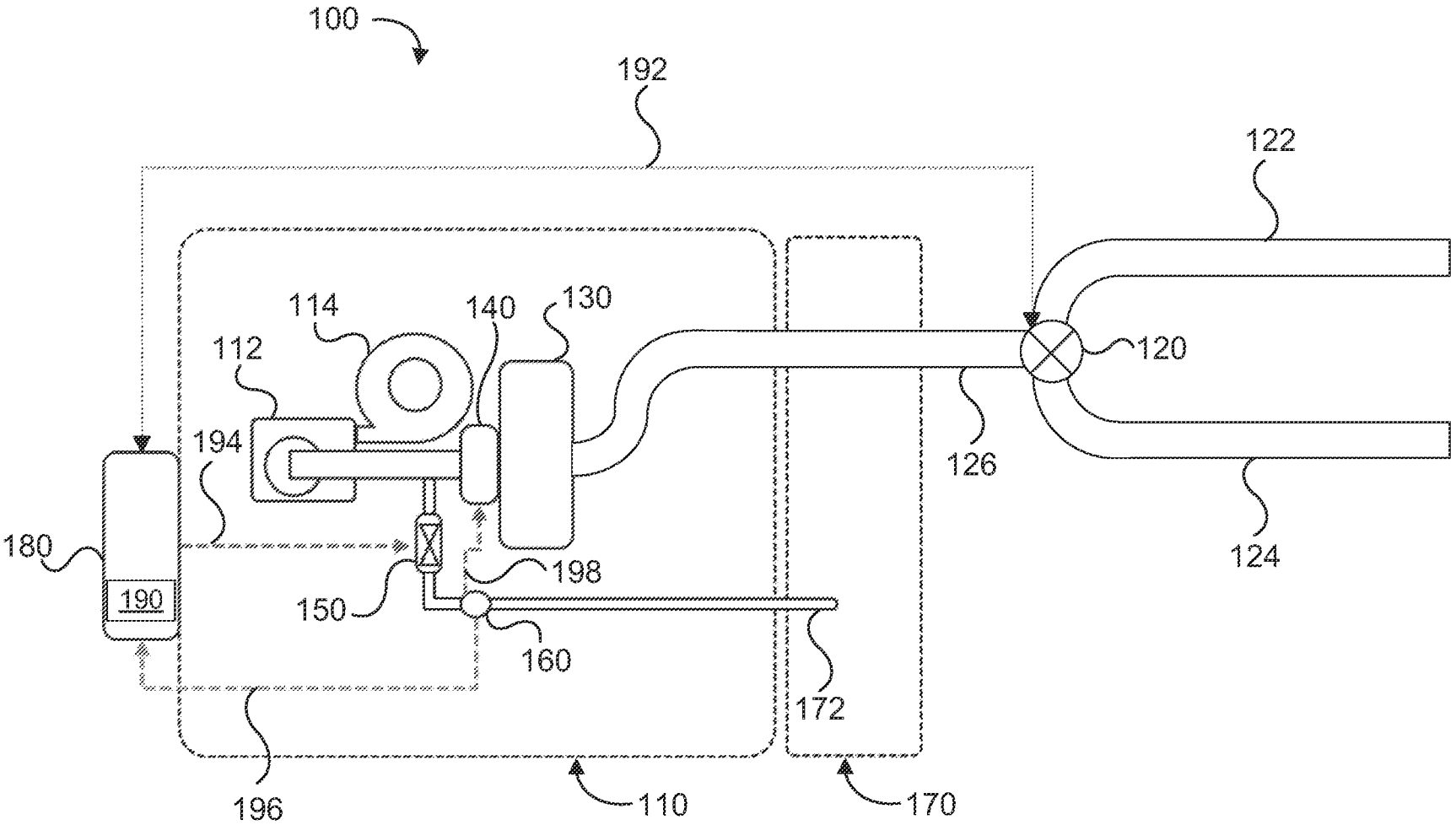
FIG. 1 is a schematic diagram illustrating a system for fuel selection for a combustion device in accordance with one or more embodiments of the present disclosure.

Systems and methods for fuel selection for combustion devices are described In particular embodiments, the systems and methods are configured for fuel selection for dual-fuel compatible combustion devices that allow for automatic changeover between fuels. As such, the systems and methods described herein advantageously can automatically change between fuel sources, tune the combustion device to be compatible with the new fuel source, and/or check to ensure the action of switching fuels has been fully accomplish prior to attempting an ignition.

While the present disclosure may refer to dual fuel compatible combustion devices, those skilled in the art will recognize that the disclosed systems and methods are not so limited and may be applied to a variety of different combustion devices, including but not limited to furnaces; boilers; water heaters; appliances; and heating, ventilation, and air conditioning (HVAC) systems that can use any number of fuel sources, such as three, four, five, or more different fuel sources/types. Moreover, the different types of fuel are not limited to any specific fuel types and can include liquid propane, natural gas, hydrogen, kerosene, and heating oil, as non-limiting examples.

Similarly, the disclosed methods and systems may be applicable to other energy producing devices such as electrochemical cells (e.g., fuel cells). Moreover, the systems and methods described herein can include a plurality of combustion devices and/or other energy producing devices, each device being used with at least one particular fuel type (e.g., a combustion device for fossil fuels and a combustion device (or fuel cell) for hydrogen).

Some implementations are described more fully with reference to the accompanying drawings. The components described hereinafter as making up various elements of the disclosed technology are intended to be illustrative and not restrictive.

Herein, the use of terms such as "can" or "may" are intended to be open-ended and to reflect that structure, material, or acts are not necessary. To the extent that structure, material, or acts are presently considered to be essential, they are identified as such.

The mention of one or more method steps does not preclude the presence of additional method steps or intervening method steps between those steps expressly identified. Similarly, the mention of one or more components in a device or system does not preclude the presence of additional components or intervening components between those components expressly identified. Further, it is contemplated that the disclosed methods and processes can include, but do not necessarily include, all steps discussed herein.

Referring now to the drawings, in which like numerals represent like elements, examples of the present disclosure are described. As will be described in greater detail, the present disclosure can include systems and methods for fuel selection for combustion devices.

As shown in FIG. 1, a combustion system 100 is configured to receive fuel from a plurality of fuel sources. This system configuration provides sampling downstream of the main valve, which advantageously may help to keep ignition modules to a lower risk of leaking. While the combustion system 100 is illustrated as being in communication with two fuel sources, the combustion system 100 can alternatively be in communication with three, four, five, or more fuel sources, as explained herein. The combustion system 100 can include a combustion device 110 configured to receive fuel and air and combust a resulting fuel-air mixture. The combustion device 110 can be fluidly connected to a plurality of fuel sources and a fuel selector valve 120 configured to select a current fuel source from among the plurality of fuel sources. For example, the fuel selector valve 120 can be configured to close a fuel source that is currently providing fuel to the combustion device 110 and switch to a different fuel source, as necessary. The combustion system 100 can further include a fuel valve 130 as described more fully herein. For example, the fuel valve 130 can control the flow of fuel into the combustion device 110. The combustion system can further include a shutter 140 as described more fully herein. For example, the shutter 140 can control the flow of air that is mixed with the fuel in the combustion device 110. The combustion system 100 can further include a fuel sample valve 150 and a fuel composition sensor 160 as described more fully herein. For example, the fuel composition sensor 160 can be configured measure and/or detect the fuel currently being provided to the combustion device 110 to check to make sure the action of switching fuels has been fully accomplish prior to attempting combustion.

The combustion device 110 can be any combustion device known in the art, including, but not limited to, furnaces; boilers; water heaters; appliances; heating, ventilation, and air conditioning (HVAC) systems; generators; and the like; or any combination thereof. The combustion device 110 can include a burner 112, which can be configured to receive fuel from a fuel source and air from a shutter 140, and the burner 112 can be configured to facilitate combustion of the resultant fuel-air mixture. The burner 112 can be configured to operate with a plurality of fuel sources, as described more fully herein.

In addition, the combustion device can include a blower 114. The blower 114 can be configured to provide a forced draft or induced draft at the burner 112. In some embodiments, the blower 114 can receive air from the shutter 140 and push that air through the burner 112. In some embodiments, the blower can pull air from the shutter 140 through the burner 112. In some other embodiments, the blower 114 can receive ambient air (e.g., room air) and push that air through the burner 112. In some other embodiments, the blower 114 can pull ambient air (e.g., room air) through the burner 112. In some embodiments, the blower 114 can help push or pull combustion gases and/or any uncombusted air from the burner 112 or a heat exchanger, which can be configured to transfer heat from the hot combustion gases to another medium such as air being passed over the heat exchanger, to the exhaust. The blower 114 can be any blower or fan known in the art, including, but not limited to, a centrifugal fan or an axial fan.

The fuel selector valve 120 can be in fluid communication with the plurality of fuel sources on an inlet side of the fuel selector valve 120 and in fluid communication with the burner 112 on an outlet side of the fuel selector valve 120. As illustrated in FIG. 1, a first fuel line 122 can be connected to a first inlet of the fuel selector valve 120, and a second fuel line 124 can be connected to a second inlet of the fuel selector valve 120. The first fuel line 122 can be fluidly connected to a first fuel source (e.g., liquid propane). The second fuel line 124 can be fluidly connected to a second fuel source (e.g., natural gas). A common manifold 126 can be fluidly connected to the outlet of the fuel selector valve 120, and the opposite end of the common manifold 126 can be fluidly connected to the combustion device 110. If the combustion system 100 is configured to receive more than two types of fuel, the fuel selector valve 120 can be configured to select between the number of available fuel types. For example, the fuel selector valve 120 can have a dedicated inlet for each available fuel type. In some embodiments, the combustion system 100 can include a series of fuel selector valves 120. For example, each fuel line 122, 124 can include a dedicated valve (e.g., a solenoid valve), which can be configured to selectively permit or prevent a flow of fuel therethrough. In some embodiments, the combustion system 100 can include a series of dual-inlet fuel selector valves 120 that can be arranged to selectively permit or prevent a flow of fuel from each fuel source.

The combustion device 110 can include a fuel valve 130 configured to control the flow of fuel to the combustion device 110. As illustrated in FIG. 1, the fuel valve 130 can be downstream of the common manifold 126 and upstream of the burner 112 such that fuel can flow from the common manifold 126 through the fuel valve 130 to the burner 112. The fuel valve 130 can regulate the flow rate of fuel. Alternatively, or in addition, the fuel valve 130 can open and close to selectively allow or prevent the flow of fuel.

The combustion device 110 can include a shutter 140. The shutter 140 can include one or more openings configured to intake air into the combustion device 110. The size of the one or more openings in the shutter 140 can be adjusted or modulated so that the flow rate of air intake into the combustion system 100 can be adjusted. For example, the shutter 140 can be configured to adjust between a plurality of shutter positions, each shutter position corresponding to a different size of the one or more openings in the shutter 140. The shutter 140 can be an air shutter, damper, louver, and the like, or any combination thereof. The shutter 140 can be configured to facilitate mixing of the fuel and air received from the blower 114. For example, the shutter 140 can be positioned to control the air-to-fuel ratio entering the burner 112. As illustrated in FIG. 1, the shutter 140 can be downstream of the fuel valve 130 and upstream of the burner 112 such that fuel can flow from the fuel valve 130 and mix with air from the shutter 140. The air-fuel mixture can then flow to the burner 112. The shutter 140 can be modulated by a controller 190 as described more fully herein. For example, the shutter 140 can be configured to modulate between a plurality of positions that provide different air-to-fuel ratios in response to a fuel selection. Alternatively, or in addition, the shutter can be configured to modulate between a range of opening positions to provide different air-to-fuel ratios in response to receiving combustion efficiency feedback as described more fully herein.

Figure 5:
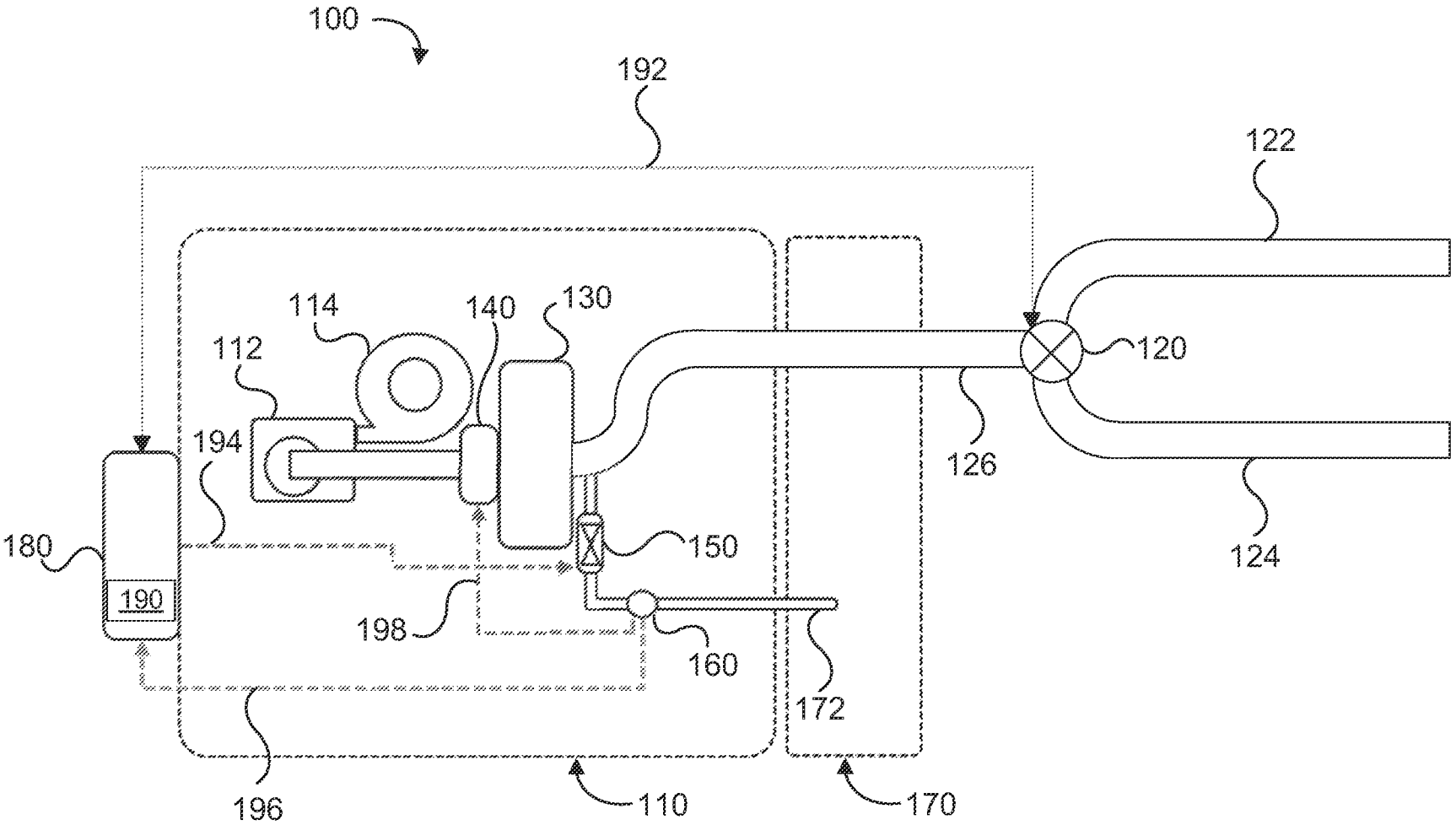
FIG. 5 is a schematic diagram illustrating a system for fuel selection for a combustion device, in accordance with one or more embodiments of the present disclosure.

The fuel sample valve 150 can be in fluid communication with the combustion device 110. As illustrated in FIG. 1, the fuel sample valve 150 can be configured to receive fuel (e.g., via a fuel sampling conduit) from a location that is upstream from the burner 112 and downstream of the shutter 140. In some embodiments, as illustrated in FIG. 5, the fuel sample valve 150 can be configured to receive fuel from a location that is upstream from the shutter 140 and/or upstream from the fuel valve 130 (e.g., from a location along the common manifold 126). The fuel sample valve 150 can be opened to allow a flow of fuel from the combustion device to the fuel composition sensor 160. Alternatively, or in addition, the fuel sample valve 150 can be opened to purge fuel from the combustion device 110 as described more fully herein.

The fuel composition sensor 160 can be a sensor configured to detect the type of fuel present. For example, the fuel composition sensor 160 can be or include an electrical reaction sensor, optical sensor, consumable sensor, voltage divider network, and the like, or any combination thereof. The fuel composition sensor 160 can be located downstream of the fuel sample valve 150 (e.g., as illustrated in FIG. 1). In some embodiments, the fuel composition sensor 160 can be located along and/or within the common manifold 126 such that it is configured to detect the type of fuel present within the common manifold 126. For example, the fuel composition sensor 160 can be located along and/or within the common manifold 126 upstream of the fuel valve 130. In some other embodiments, the fuel composition sensor 160 can be located along and/or within the common manifold 126 downstream of the fuel valve 130.

The fuel sample valve 150 and/or the fuel composition sensor 160 can be in fluid communication with a vent 170. For example, the vent 170 can be or include an outside vent and/or a common building vent. As illustrated in in FIG. 1, the fuel sample valve 150 can be in fluid communication with the vent 170 through a vent pipe 172. The vent pipe 172 can allow any fuel being sampled or purged, by opening the fuel sample valve 150, to be vented and/or discharged. In some embodiments, any fuel being sampled or purged can be vented and/or discharged to the exhaust of the combustion system 100 (e.g., the exhaust downstream of the burner and/or heat exchanger of the combustion system). For example, fuel within the common manifold 126 can be sampled with the fuel composition sensor 160 and then discharged to the exhaust of the combustion system 100.

The combustion system 100 can include a fuel selector 180. The fuel selector 180 can be used to select a fuel type for the combustion system 100. For example, the fuel selector 180 can include a mechanical selector (e.g., a knob, switch, button) or an electronic user interface (e.g., a computer with one or more peripheral devices, a touchscreen display) that enables a user to manually select a fuel type. Alternatively, or in addition, the fuel selector 180 and/or the controller 190 (which can be included in the fuel selector 180) can be configured to receive instructions (e.g., selection of a fuel type) from a remote device (e.g., a mobile computing device, a remote controller) in wired or wireless communication with the fuel selector 180 and/or the controller 190.

The combustion system 100 can include a controller 190 configured to receive data (e.g., from one or more sensors) and output instructions to one or more components (e.g., the fuel valve 130, the shutter 140) based at least in part on the received data. For example, the controller 190 can be configured to perform the methods described herein (or any part thereof). The controller 190 can be or include any HVAC control system known in the art, including but not limited to, a dedicated controller for the combustion system, a controller for a central HVAC system, a locally located controller, a remotely located controller (e.g., backend server), and the like, or any combination thereof. In some embodiments, the controller 190 can be capable of integrating with a building management system (BMS) or building automation system (BAS). For example, the controller 190 can communicate with the central HVAC system to receive fuel changeover information or relay status information or alerts regarding the combustion system.

Figure 2:
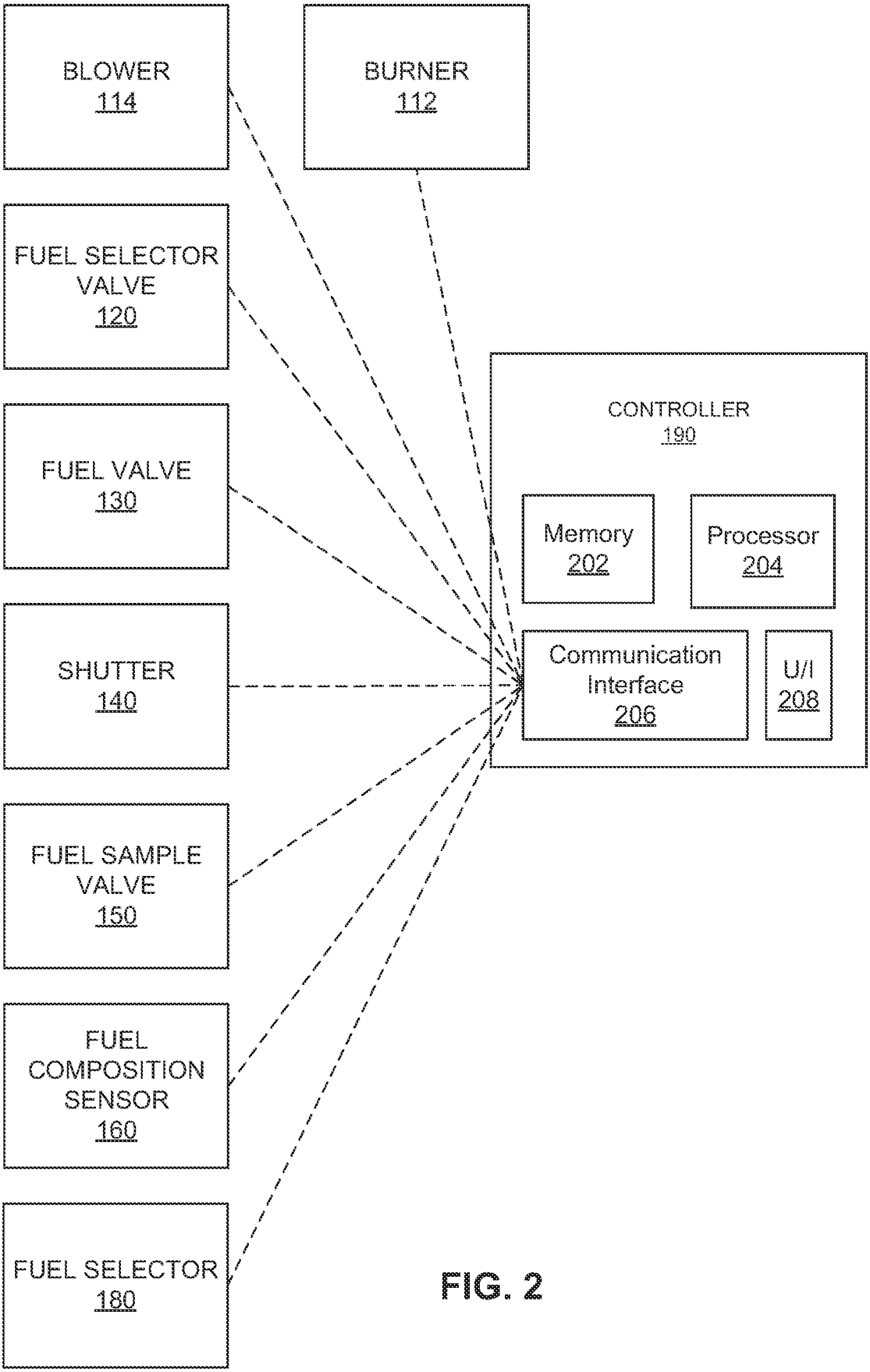
FIG. 2 is a schematic diagram illustrating a controller in accordance with one or more embodiments of the present disclosure.

As shown in FIGS. 1 and 2, the controller 190 can be configured to communicate with the fuel selector valve 120. For example, the controller 190 can receive an indication of a selected fuel type from the fuel selector valve 120 (shown as communication path 192). Alternatively, or in addition, the controller can output instructions to the fuel selector valve 120 for selecting a given fuel type. The fuel selector valve 120 can be configured to receive instructions from the controller 190 and permit a flow of the selected select fuel type in accordance with those instructions. In some embodiments, the controller 190 can be configured to communicate with the fuel sample valve 150. For example, the controller 190 can output instructions for the fuel sample valve 150 to open and close (shown as communication path 194). In some embodiments, the controller 190 can be configured to communicate with the fuel composition sensor 160. For example, the controller 190 can receive an indication of the fuel type sensed by the fuel composition sensor 160 (shown as communication path 196). In some embodiments, the controller 190 can be configured communicate with the shutter 140. For example, the controller 190 can output instructions for the shutter 140 to adjust the shutter position based on the fuel type selected and/or the fuel type confirmed (shown as communication path 198).

As shown in FIG. 2, the controller 190 can include memory 202, a processor 204, a communication interface 206, and/or a user interface 208. The memory 202 can have instructions stored thereon that, when executed by the processor 204, cause the controller 190 to perform certain actions, such as the actions and methods (e.g., some or all of method 300) described herein. Alternatively, or in addition, the memory 202 can store data, such as stored fuel data, which can be used to determine whether received fuel sample data is indicative of a given fuel type.

In some embodiments, the controller 190 can communicate with one or more sensors and/or devices. For example, the controller 190 can receive data from a fuel composition sensor 160 and the fuel selector 180. In some embodiments, the controller 190 can output instructions to the burner 112, the blower 114, the fuel selector valve 120, the fuel valve 130, the shutter 140, and/or the fuel sample valve 150 (e.g., in accordance with some or all of one or more methods described herein). Additionally, or alternatively, the controller 190 can receive data from a burner 112 (e.g., data indicative of a burner status or efficiency), a blower 114 (e.g., data indicative of a blower status or speed), a fuel selector valve 120 (e.g., data indicative of a current valve position and/or a current flow rate), a fuel valve 130 (e.g., data indicative of a current valve position and/or a current flow rate), a shutter 140 (e.g., data indicative of a current shutter position and/or a current air-to-fuel ratio), and/or a fuel sample valve 150 (e.g., data indicative of a current valve position and/or a current flow rate).

Figure 3:
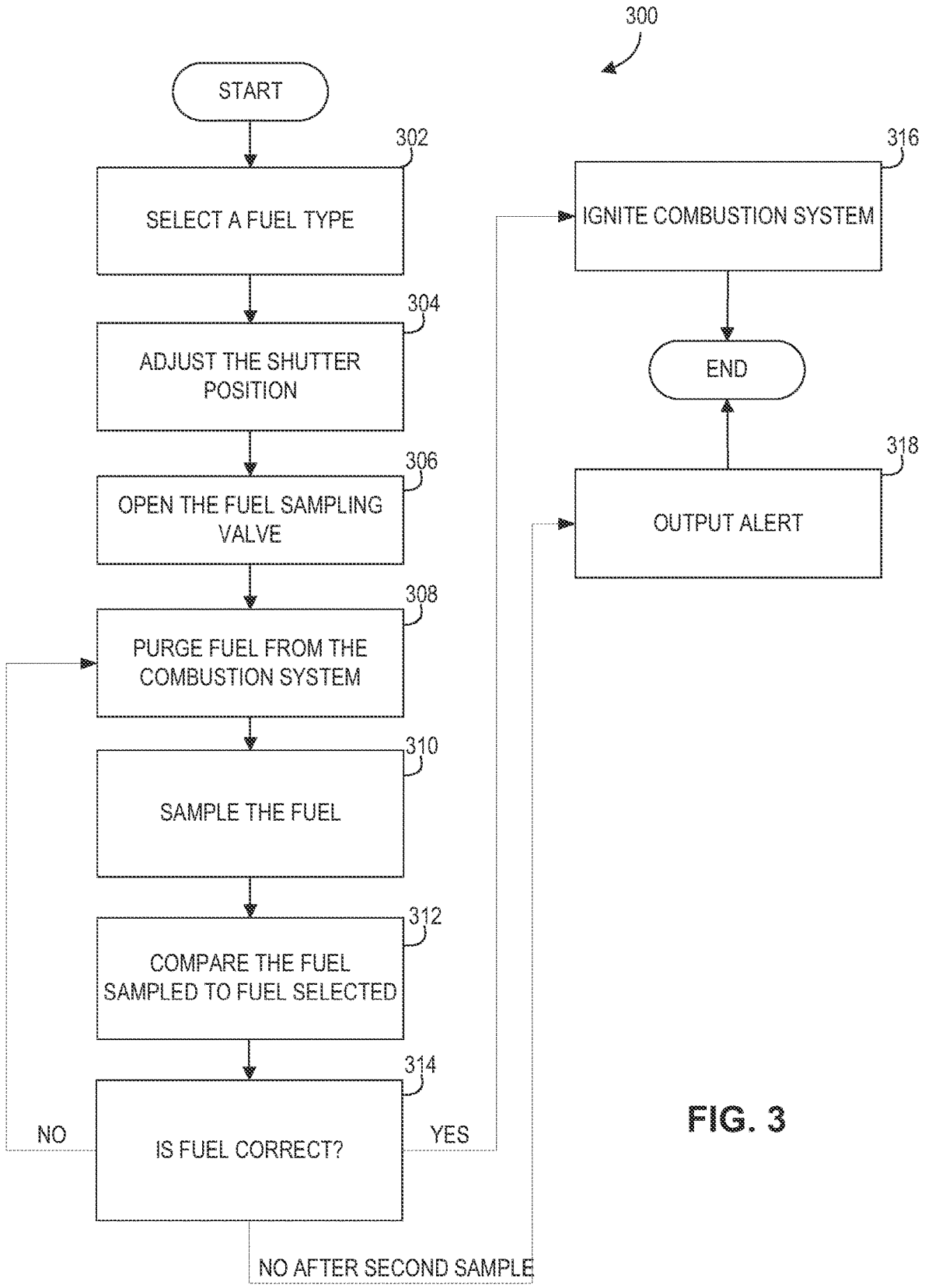
FIG. 3 is a flow chart illustrating a method for fuel selection for a combustion device in accordance with one or more embodiments of the present disclosure.

One embodiment of a method 300 for controlling the combustion system 100 is illustrated in FIG. 3. Method 300 and/or any other method described herein can be performed by a controller or computer, such as the controller 190 described herein (e.g., a controller or computer can be configured to output instructions for one or more components to perform certain actions as described in relation to method 300 and/or any other methods described herein).

The method 300 can include receiving 302 an indication of a fuel type selection. For example, the selected fuel type can be one of the fuel types associated with the plurality of fuel sources available and compatible with the combustion system 100 (e.g., one of the fuel types of a corresponding fuel source that is in fluid communication with the combustion system 100). In some embodiments, the selection of the fuel type can be a user-inputted selection (e.g., via the fuel selector 180, through a connected device, through a central building system such as BMS). In some embodiments, the selection of the fuel type can be received from an external device (e.g., via data indicating the current position of the fuel selector valve 120, through a connected device, through a central building system such as BMS). Alternatively, or in addition, the selection of the fuel type can be automated. Stated otherwise, a controller (e.g., the controller 190) can be configured to automatically select a fuel type. For example, the selection of the fuel type can be done through programmed and/or predetermined schedules (e.g., occupancy schedules, demand schedules), or based on factors such as building fuel demand (e.g., heating demand, hot water demand, combustion device demand), occupancy, fuel availability, fuel costs, and current environmental conditions.

The method 300 can include determining building occupancy and selecting the fuel based on whether the building is scheduled to be occupied or unoccupied (e.g., selecting a first fuel when the building is occupied and a second fuel when the building is unoccupied). For example, when the building is occupied the building demand (e.g., heating and hot water as provided by combustion devices in the building) can be higher. One fuel type can be better at meeting and/or responding to these higher demands (e.g., the fuel is more energy dense), while another fuel type can be cheaper, more efficient and/or greener. In some embodiments, the method 300 can include determining the building occupancy from a programmed occupancy schedule (e.g., a building occupancy schedule from a BMS). Alternatively, or in addition, the method 300 can include determining building occupancy from one or more sensors (e.g., occupancy sensors) and selecting the fuel based on whether the building or a given area is occupied or unoccupied. The method 300 can include automatically changing between the energy dense fuel when the building is scheduled to be occupied (or is actually occupied) and the more efficient, cheaper, and/or greener fuel when the building is scheduled to be unoccupied (or is actually unoccupied).

The method 300 can include determining building fuel demand. In some embodiments, the method 300 can include determining building demand from a programmed demand schedule (e.g., a building target temperature schedule, estimated hot water demand schedule) and selecting the fuel based on the scheduled demand. Alternatively, or in addition, the method 300 can include determining building demand from building sensors (e.g., thermostats, hot water flow sensors) and selecting the fuel based on measured building demand. For example, the method 300 can include automatically changing between the energy dense fuel when the building demand (e.g., heating and hot water as provided by combustion devices in the building) is scheduled to be high (or is actually measured to be high) and the more efficient, cheaper, and/or greener fuel when the building demand is scheduled to be low (or is actually measured to be low).

The method 300 can include determining the availability of the plurality of fuel sources and selecting the fuel source that has more fuel available or is currently available. For example, for fuel stored on site, the method 300 can include receiving information on the current fuel levels available and changing to whichever fuel source has more fuel available. Alternatively, or in addition, for both fuel stored on site and fuel from a main pipeline, the method 300 can include receiving information on current availability (e.g., low fuel level in tank, pipeline empty or damaged) and changing to a fuel source that is available.

The method 300 can include determining a cost associated with provide heat for each available fuel type (e.g., cost/BTU) and selecting the fuel with lowest cost. In some embodiments, the method 300 can include changing fuel types only if a predetermined increase in cost realization can be achieved. For example, the method 300 can include selecting a new fuel type only if the difference in cost is greater than or equal to 5% less than the cost associated with the current fuel type. This can help reduce excessive changes between fuel types, which could otherwise result in unnecessary down time.

The method 300 can include determining environmental factors and selecting the fuel that functions better in that specific environment. For example, the method 300 can include receiving combustion air information (e.g., temperature, humidity, oxygen levels of the combustion air) or ambient environmental information and selecting a fuel type optimized for that combustion air or those ambient conditions. The different fuel types can be more efficient with different combustion air and/or ambient air. For example, one fuel type can burn more efficiently when air temperatures are cold while another fuel type can burn when air temperatures are warm. The method 300 can include switching between these fuel types when there is a measured change in the environmental conditions (e.g., the outdoor temperature drops).

The method 300 can include adjusting 304 the shutter position. For example, the controller can be configured to output instructions for a shutter (e.g., the shutter 140) to move to a new shutter position. In some embodiments, the shutter position can be adjusted to a position configured to provide a specific air-to-fuel ratio associated with combustion of the fuel type selected. For example, in a dual-fuel system, the shutter can have two distinct position settings corresponding to each fuel type. Alternatively, or in addition, the shutter can modulate within a range of positions. For example, the shutter position can be modulated to improve combustion efficiency by adjusting the air-to-fuel ratio based on combustion efficiency feedback received, which can help account for external impacts on combustion efficiency, such as weather or other environmental impacts. In some embodiments, the combustion efficiency feedback can come from one or more sensors configured to provide combustion efficiency (e.g., flame sensor, oxygen sensor). For example, the shutter position can be modulated through an $O_2$ trim system. Specifically, the method can include receiving combustion efficiency data from one or more sensors and outputting instructions for the shutter to modulate shutter position to ensure the combustion efficiency is within a predetermined combustion efficiency range associated with the current fuel type. In some embodiments, a corresponding predetermined combustion efficiency range can be associated with each fuel type. Alternatively, or in addition, the method can include first adjusting the shutter to a predetermined position associated with combustion of the fuel type selected and then modulating the shutter position during operation of the combustion unit based on combustion efficiency feedback received.

The method 300 can include opening 306 a fuel sampling valve (e.g., fuel sample valve 150). For example, the fuel sampling valve can bias closed and can be opened to allow fuel to flow to a fuel composition sensor.

The method 300 can include purging 308 the fuel from the combustion system 100. For example, the fuel in the fuel lines of the combustion system can be purged. Purging the fuel from the combustion system can replace the fuel currently in the combustion system with new incoming fuel from an upstream fuel source. For example, the blower (e.g., blower 114) can create a pressure differential such that the fuel and air currently in the combustion system is forced out of the unit (e.g., to exhaust). At least some of the fuel and air currently in the combustion system can be forced out through the open fuel sample valve to exhaust (e.g., to the vent 170 through a vent pipe 172). The purging 308 can include turning the blower on and/or adjusting the blower airflow (e.g., adjusting fan speed). Alternatively, or in addition, the blower can be already running. For example, the blower can be turned on prior to method 300 (e.g., in response to receiving a call for heat). Alternatively, or in addition, purging 308 the fuel from the combustion system can occur as result of the gas sample valve opening. For example, opening 306 the fuel sampling valve can allow the fuel and air from the combustion system to exhaust through the fuel sample valve (e.g., fuel sample valve 150) to exhaust (e.g., to the vent 170 through a vent pipe 172).

The method 300 can include sampling 310 the fuel. For example, a fuel composition sensor (e.g., fuel composition sensor 160) can sample the fuel and provide an analysis of the fuel type. The fuel type sensed by the fuel composition sensor can be communicated to a controller or other remotely located device (e.g., a connected device, a central building system).

The method 300 can include comparing 312 the fuel type sampled (e.g., the fuel typed sensed at 310) the to the selected fuel type (e.g., the fuel type selected at 302). For example, the method 300 can include receiving the sample data from the fuel composition sensor and comparing the fuel sample data to stored fuel data to determine whether the fuel sample data is indicative of the selected fuel type.

The method 300 can include determining 314 whether the fuel type of the sampled fuel is the same as the selected fuel type. If the fuel type of the sampled fuel matches the selected fuel type, the method 300 can proceed to igniting 316 the fuel-air mixture as described more fully herein. If the fuel type of the sampled fuel does not match the selected fuel type, the method 300 can again purge 308 the fuel from the combustion system, sample 310 the fuel, compare 312 the fuel type sampled to the fuel type selected, and continue the method 300 as discussed above. If the fuel type of the subsequently sampled fuel matches the selected fuel type, the method 300 can proceed to igniting 316 the fuel-air mixture. In some embodiments, if the fuel type of the subsequently sampled fuel still does not match the selected fuel type, the method 300 can include outputting 318 an alert. For example, an alert indicating that the incorrect fuel type is in the combustion system can be provided (e.g., via a user interface on the combustion system, to a mobile computing device, to a central building system). Alternatively, or in addition, the method 300 can include again repeating the purging 308, sampling 310, comparing 312, and determining 314 steps a predetermined number of times prior to outputting an alert or taking alternative measures (e.g., two or more times). Alternatively, or in addition, the combustion system can be prevented from igniting (e.g., disable the burner's ignitor) on a determination that the fuel type selected at 302 does not match the fuel typed sensed at 310.

The method 300 can include igniting 316 the fuel-air mixture. For example, on determining 314 that the fuel type selected at 302 matches the fuel typed sensed at 310, an ignition device (e.g., ignitor, ignition electrode, spark plug, pilot light) can be activated to create a spark and/or heat that causes the adjacent fuel-air mixture to combust.

Thus far the disclosed technology has been described to switch between fuel sources to a single energy producing apparatus (e.g., burner 112) in a combustion device 110. In addition, the disclosed technology can selectively alternate between a plurality of energy producing apparatuses (e.g., burners, combustion engines, turbines, electrochemical cells) in a combustion device 110.

Figure 4:
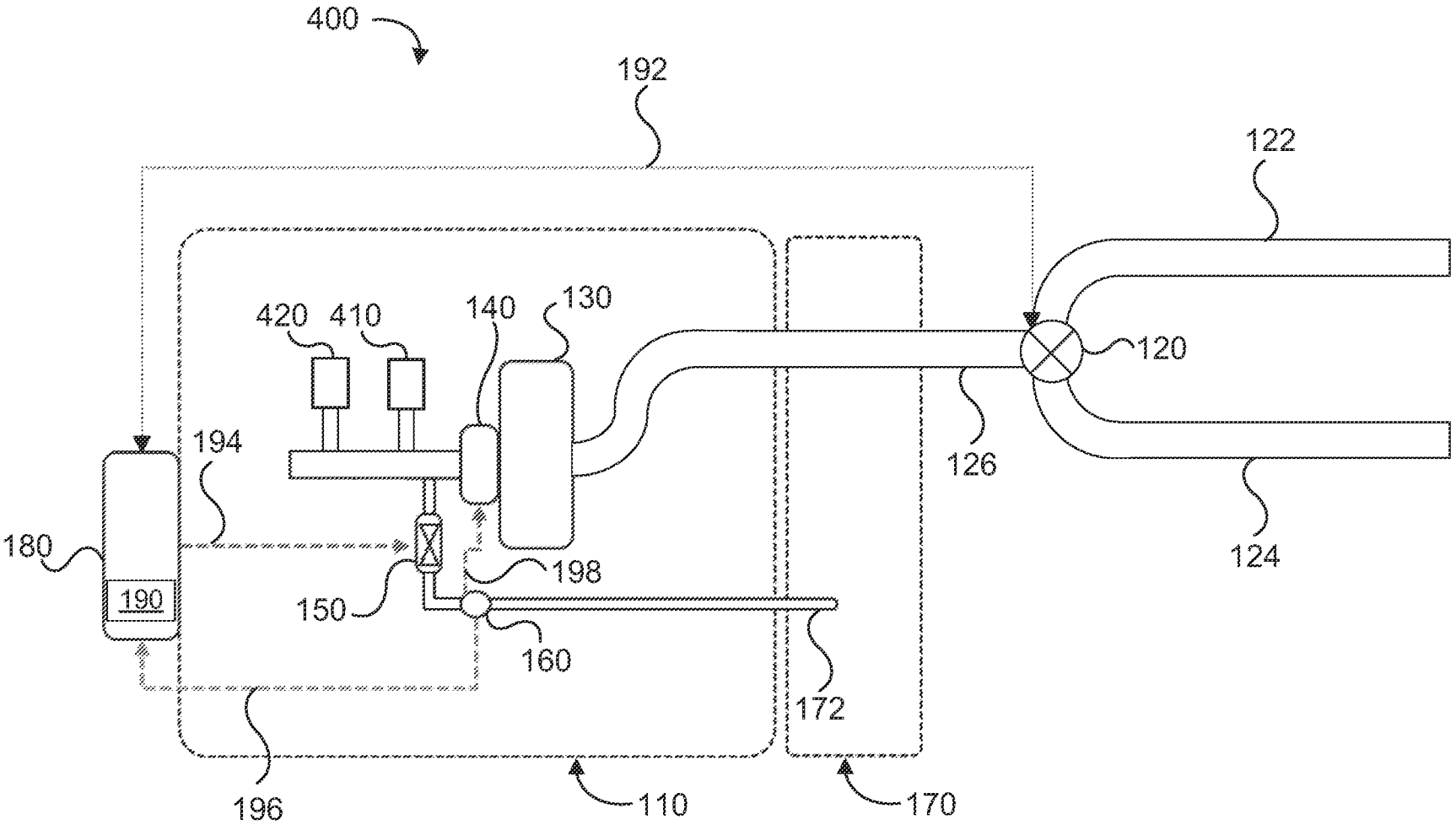
FIG. 4 is a schematic diagram illustrating a system for fuel selection for energy producing apparatuses in accordance with the present disclosure.

As shown in FIG. 4, the combustion device 110 can alternatively include a first energy producing apparatus 410 and a second energy producing apparatus 420. For example, the first energy producing apparatus 410 can be a first combustion apparatus (e.g., a burner for fossil fuel combustion), which can be the same or substantially the same as burner 112. The first and second energy producing apparatuses 410, 420 can share the same blower (which can be the same or substantially the same as blower 114), or either energy producing apparatus 410, 420 can have its own dedicated blower (which can each be the same or substantially the same as blower 114). The second energy producing apparatus 420 can be a second combustion apparatus (e.g., a burner for hydrogen combustion). In some embodiments, the second energy producing apparatus 420 can be an electrochemical cell (e.g., a hydrogen fuel cell), or another alternative fuel source.

The energy producing system 400 can operate substantially the same as the combustion system 100 described thus far but instead of providing fuel to a single energy producing apparatus (e.g., burner 112), fuel is provided to a plurality energy producing system apparatuses (e.g., first and second energy producing apparatus 410, 420). As with the burner 112 depicted in FIG. 1, the first energy producing apparatus 410 and the second energy producing apparatus 420 can be located downstream of the fuel sample valve 150 (as depicted in FIG. 4).

In addition, the energy producing system 400 can selectively alternate between a plurality of energy producing apparatuses based on a fuel selection. For example, the first energy producing apparatus 410 can be configured to operate with a first fuel type (e.g., liquid propane, natural gas), and the second energy producing apparatus 420 can be configured to operate with a second fuel type (e.g., hydrogen). When the first fuel type is selected, the system can be configured to operate the first energy producing apparatus 410. When the second fuel type is selected, the system can be configured to operate the second energy producing apparatus 420. For example, on a selection of the first fuel type, the first energy producing apparatus 410 can be activated, and the second energy producing apparatus 420 can be deactivated (or remain deactivated). Alternatively, or in addition, the fuel line entering the first energy producing apparatus 410 can be opened (e.g., via a valve), and the fuel line entering the second energy producing apparatus 420 can be closed (or remain closed).

The energy producing system 400 selectively alternating between a plurality of energy producing apparatuses based on a fuel selection can occur after the system 400 determines that the fuel is correct. For example, the system 400 can determine that the current fuel is correct (e.g., determining 314 whether the fuel type of the sampled fuel is the same as the selected fuel type) and then select the appropriate energy producing apparatus 410, 420 based on the confirmed fuel type. In some embodiments, the selection of an energy producing apparatuses based on a fuel selection can occur after fuel selection.

In some embodiments, as discussed herein for system 100, system 400 can similarly prevent the energy producing apparatuses from starting energy production (e.g., before ignition in a combustion apparatus or before beginning an electrochemical reaction in an electrochemical cell) prior to the determination that the fuel is correct (e.g., determining 314 whether the fuel type of the sampled fuel is the same as the selected fuel type).

It is to be understood that the embodiments and claims disclosed herein are not limited in their application to the details of construction and arrangement of the components set forth in the description and illustrated in the drawings.

That which is claimed is:

1. A combustion system configured to receive fuel from a plurality of fuel sources, the combustion system comprising:
- a burner;
- a shutter;
- a fuel selector; and
- an electronic controller configured to:
  - receive an indication of a selected fuel type from the fuel selector;
  - receive fuel sample data of a detected fuel type from a fuel composition sensor:
  - determine whether the fuel sample data is indicative of the selected fuel type:
  - if the detected fuel type is indicative of the selected fuel type, output instructions for the shutter to adjust to a shutter position associated with the selected fuel type, the shutter position being configured to provide a predetermined supply of air to thereby effect an air-to-fuel ratio associated with combustion of the selected fuel type; and
  - if the detected fuel type is not indicative of the selected fuel type, output instructions for the fuel sampling valve to open to perform a supplemental purge of fuel from the combustion system, wherein the supplemental purge of fuel discharges replacement fuel from the combustion system and intakes supplemental replacement fuel into the combustion system.

2. The combustion system of claim 1
- wherein the electronic controller is further configured to:
  - output instructions for the fuel sampling valve to open to perform a purge of fuel from the combustion system, wherein the purge of fuel discharges initial fuel from the combustion system and intakes replacement fuel into the combustion system;
  - receive fuel sample data from the fuel composition sensor; and
  - compare the fuel sample data to stored fuel data to determine whether the fuel sample data is indicative of the selected fuel type.

3. The combustion system of claim 2, wherein the electronic controller is further configured to output instructions for the burner to ignite the fuel in response to determining that the fuel sample data is indicative of the selected fuel type.

4. The combustion system of claim 1 further comprising:
- one or more fuel selector valves configured to selectively permit or prevent flows of fuel from the plurality of fuel sources such that a single flow of fuel is permitted to flow through the one or more fuel selector valves at a given time, wherein an outlet side of the one or more fuel selector valves is configured to output the selected fuel type for combustion in the burner.

5. The combustion system of claim 4, wherein the electronic controller is configured to output instructions for the one or more fuel selector valves to permit flow of the selected fuel type.

6. The combustion system of claim 4 further comprising a common manifold fluidly connected to the outlet side of each of the one or more fuel selector valves, the common manifold being fluidly connected to the burner.

7. The combustion system of claim 1, wherein the electronic controller is further configured to:

output instructions for the shutter to adjust to (i) a first position when the selected fuel type is a first fuel type and (ii) a second position when the selected fuel type is a second fuel type, wherein the first position is configured to provide an air-to-fuel ratio associated with combustion of the first fuel type and the second position is configured to provide an air-to-fuel ratio associated with combustion of the second fuel type.

8. The combustion system of claim 1 further comprising:

a combustion efficiency sensor configured to measure combustion efficiency of the burner, wherein the electronic controller is configured to:

receive combustion efficiency data from the combustion efficiency sensor; and output instructions for the shutter to modulate based at least in part on the combustion efficiency data.

9. A combustion system configured to receive fuel from a plurality of fuel sources, the combustion system comprising:

a burner;

a shutter;

a fuel selector;

a fuel sample valve;

a fuel composition sensor configured to determine a fuel type; and an electronic controller configured to:

receive an indication of a selected fuel type from the fuel selector;

output instructions for the shutter to adjust to a shutter position associated with the selected fuel type, the shutter position being configured to provide a predetermined supply of air to thereby effect an air-to-fuel ratio associated with combustion of the selected fuel type;

output instructions for the fuel sampling valve to open to perform a purge of fuel from the combustion system, wherein the purge of fuel discharges initial fuel from the combustion system and intakes replacement fuel into the combustion system;

receive fuel sample data from the fuel composition sensor;

compare the fuel sample data to stored fuel data to determine whether the fuel sample data is indicative of the selected fuel type:

determine that the fuel sample data is not indicative of the selected fuel type;

output instructions for the fuel sampling valve to open to perform a supplemental purge of fuel from the combustion system, wherein the supplemental purge of fuel discharges the replacement fuel from the combustion system and intakes supplemental replacement fuel into the combustion system;

receive supplemental fuel sample data from the fuel composition sensor; and compare the supplemental fuel sample data to stored fuel data to determine whether the supplemental fuel sample data is indicative of the selected fuel type.

10. The combustion system of claim 9, wherein the electronic controller is further configured to output instructions for the burner to ignite the fuel in response to determining that the supplemental fuel sample data is indicative of the selected fuel type.

11. The combustion system of claim 9, wherein the electronic controller is further configured to:

in response to determining that the fuel sample data is not indicative of the selected fuel type:

output an alert to a user; and output instructions for disabling the burner to prevent ignition of the fuel.

12. A system configured to receive fuel from a plurality of fuel sources, the combustion system comprising:

a plurality of energy producing apparatuses;

a shutter;

a fuel selector;

a fuel sample valve;

a fuel composition sensor configured to determine a fuel type; and an electronic controller configured to:

receive an indication of a selected fuel type from the fuel selector;

receive fuel sample data of a detected fuel type from a fuel composition sensor;

determine that the fuel sample data is not indicative of the selected fuel type;

output instructions to select one of the plurality of energy producing apparatus associated with the selected fuel type;

output instructions for the shutter to adjust to a shutter position associated with the selected fuel type, the shutter position being configured to provide a predetermined supply of air associated with the selected fuel type to thereby effect an air-to-fuel ratio associated with combustion of the selected fuel type if the detected fuel type is the selected fuel type; and output instructions for the fuel sampling valve to open to perform a supplemental purge of fuel from the combustion system, wherein the supplemental purge of fuel discharges the replacement fuel from the combustion system and intakes supplemental replacement fuel into the combustion system if the detected fuel type is not the selected fuel type.

13. A method of tuning a combustion system configured to receive fuel from a plurality of fuel sources, the method comprising:

actuating a fuel selector valve to permit a flow of fuel of a selected fuel type;

adjusting a shutter to a shutter position associated with the selected fuel type, the shutter position being configured to provide a predetermined supply of air to thereby effect an air-to-fuel ratio associated with combustion of the selected fuel type;

opening a fuel sampling valve;

purging initial fuel from the combustion system, wherein purging initial fuel comprises discharging initial fuel from the combustion system and intaking replacement fuel into the combustion system;

sampling the replacement fuel with a fuel composition sensor configured to determine a detected fuel type of the replacement fuel; and comparing the detected fuel type to the selected fuel type, wherein the fuel sampling valve is located downstream of a fuel valve and upstream of a burner, and wherein the fuel sampling valve is fluidically connected to a vent via a vent pipe.

14. The method of claim 13 further comprising:

determining that the detected fuel type matches the selected fuel type; and igniting the fuel in the combustion system.

15. The method of claim 13 further comprising:

determining that the detected fuel type does not match the selected fuel type;

purging the replacement fuel from the combustion system, wherein purging the replacement fuel comprises discharging the replacement fuel from the combustion system and intaking supplemental replacement fuel into the combustion system;

sampling the supplemental replacement fuel with the fuel composition sensor to determine a detected supplemental fuel type of the supplemental replacement fuel; and comparing the detected supplemental fuel type to the selected fuel type.

16. The method of claim 15 further comprising:

determining that the detected supplemental fuel type matches the selected fuel type; and igniting the fuel in the combustion system.

17. The method of claim 15 further comprising:

in response to determining that the detected supplemental fuel type does not match the selected fuel type:

outputting an alert; and preventing ignition in the combustion system.

18. The method of claim 13 further comprising:

selecting the selected fuel type based at least in part on a predetermined occupancy schedule, a predetermined demand schedule, a current fuel demand associated with the combustion system, an occupancy of a space associated with the combustion system, a current fuel availability, one or more current fuel costs, or one or more current environmental conditions.

19. The method of claim 13 further comprising:

adjusting a shutter to a first position when the selected fuel type is a first fuel type and to a second position when the selected fuel type is a second fuel type, wherein the first position is configured to provide an air-to-fuel ratio associated with combustion of the first fuel type and the second position is configured to provide an air-to-fuel ratio associated with combustion of the second fuel type.

20. The method of claim 13 further comprising:

receiving combustion efficiency feedback from a combustion efficiency sensor; and modulating the shutter based on the combustion efficiency feedback.

* * * * *